United States Patent [19]

Sakuma et al.

[11] Patent Number: 4,499,349

[45] Date of Patent: Feb. 12, 1985

[54] VACUUM INTERRUPTER

[75] Inventors: Shinzo Sakuma, Kawasaki; Junichi Warabi; Masayuki Kano, both of Shizuoka; Yutaka Kashimoto, Numazu, all of Japan

[73] Assignee: Kabushiki Kaisha Meidensha, Tokyo, Japan

[21] Appl. No.: 441,735

[22] Filed: Nov. 15, 1982

[30] Foreign Application Priority Data

Nov. 20, 1981 [JP] Japan ..... 56-186709
Dec. 18, 1981 [JP] Japan ..... 56-204762

[51] Int. Cl.[3] ..... H01H 33/66
[52] U.S. Cl. ..... 200/144 B
[58] Field of Search ..... 200/144 B

[56] References Cited

U.S. PATENT DOCUMENTS 4,414,448 11/1983 Kashimoto et al. ..... 200/144 B
4,417,110 11/1983 Yanagisawa et al. ..... 200/144 B

FOREIGN PATENT DOCUMENTS 43186 1/1982 European Pat. Off. .
43258 1/1982 European Pat. Off. .
57-13637 1/1982 Japan .
1131922 10/1968 United Kingdom .
1504666 3/1978 United Kingdom .

*Primary Examiner*—Robert S. Macon
*Attorney, Agent, or Firm*—Lowe, King, Price & Becker

[57] ABSTRACT

A vacuum interrupter has a hollow metallic cylinder, insulating end plates made of inorganic insulating material and connected to the opposite ends of the metallic cylinder, stationary and movable lead rods which extend into the metallic cylinder through the insulating end plates and which support separable electrical contacts, a bellows connecting the movable lead rod to the corresponding insulating end plate, and auxiliary sealing members which connect the metallic cylinder to both the insulating end plates by means of brazing. At least one of each pair of members to be brazed has a groove for solid brazing material which is closed from the vacuum chamber of the interrupter. The vacuum interrupter facilitates arrangement of the solid brazing material in a temporary assembly step and greatly reduces the amount of vaporized brazing material dispersed into the vacuum chamber of the interrupter in a vacuum brazing step. Thus, the interrupter is provided with improved dielectric strength.

6 Claims, 10 Drawing Figures

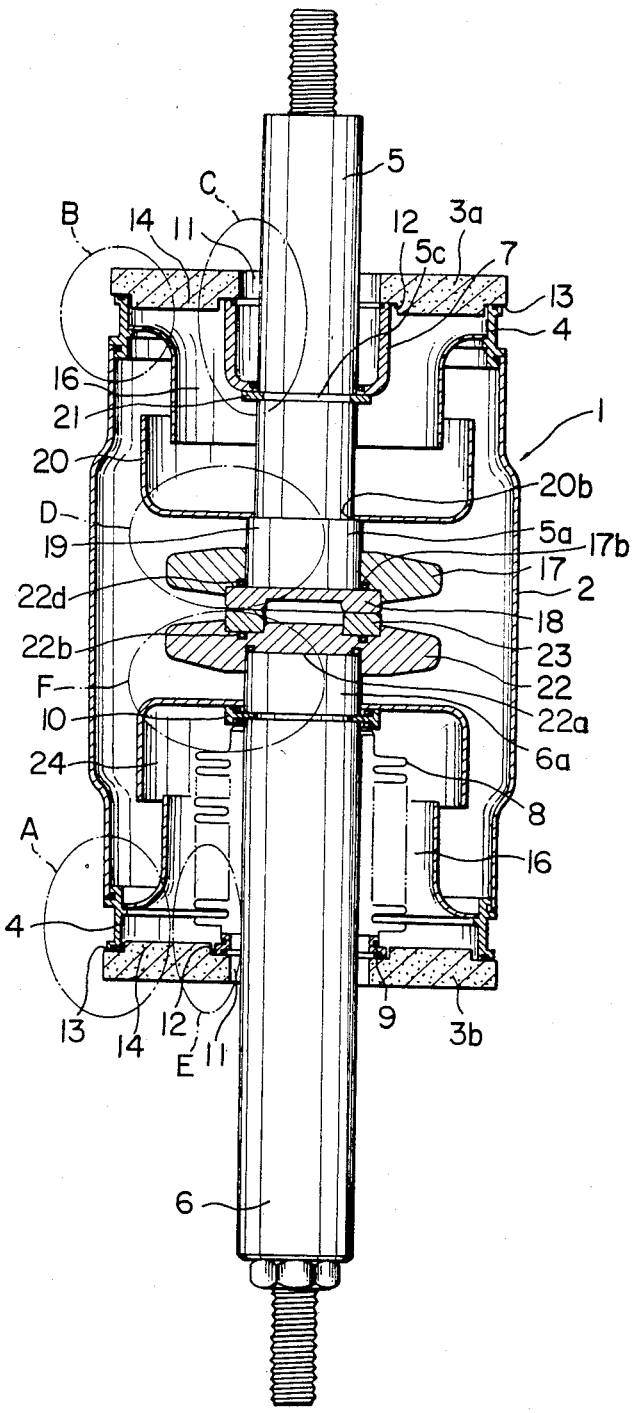
5
C
B
14
11
12
3a
5c
7
13
4
16
21
1
20
20b
D
19
5a
17b
17
22d
2
18
22b
23
F
22
10
22a
24
6a
8
A
16
4
13
14
12
E
11
9
3b
6

VACUUM INTERRUPTER

BACKGROUND OF THE INVENTION

The present invention relates to a vacuum interrupter, particularly to the vacuum interrupter in which two separable electrical contacts are surrounded by a vacuum envelope including a cylindrical metallic housing and insulating end plates provided at opposite ends of the housing.

This kind of vacuum interrupter was invented by Sakuma et al., the present inventors, and was first disclosed in the co-pending U.S. patent application Ser. No. 276,862 filed on June 24, 1981.

The vacuum interrupter of this kind is manufactured as follows; first, temporary assembly of the vacuum interrupter is performed by accurately positioning the members of the interrupter with the aid of a jig such that solid brazing material of a certain thickness has been fitted into the clearances between surfaces which are to be joined of the vacuum interrupter, and then, the temporarily assembled vacuum interrupter is brazed into vacuum-tightness in a vacuum furnace.

Two surfaces to be joined of the vacuum interrupter are directly exposed to a chamber to be maintained vacuum-tight (hereinafter referred to a vacuum chamber of the interrupter). In addition, with regard to material, the insulating end plates, may be made of ceramics such as, for example, aluminum oxide ceramics $Al_2O_3$, which has a relatively large heat emissivity, that is, will increase rapidly in temperature during heating, and drop in temperature rapidly during cooling.

Therefore, vaporized brazing material will tend to disperse throughout the vacuum chamber of the interrupter during heating in the vacuum furnace and will be deposited on the interior surfaces of the insulating end plates during the slow cooling process. This increases the electrical conductivity of the insulating end plate which greatly lowers the vacuum surface withstand voltage of the end plate.

SUMMARY OF THE INVENTION

A primary object of the present invention is to provide a vaccum interrupter the manufacturing cost of which is minimized and which has an increased dielectric strength, by improving the arrangement of solid brazing material.

Another object of the present invention is to provide a vacuum interrupter in which receptacles for solid brazing material are provided in at least one of two members of the vacuum interrupter to be brazed so as to prevent solid brazing material from being exposed to the vacuum chamber of the vacuum interrupter. In accordance with this invention, it is possible to minimize the amount of vaporized brazing material dispersed into the vacuum chamber of the interrupter, thereby preventing vaporized brazing material from being deposited on inner surfaces of the members of the interrupter which are exposed to the vacuum chamber of the interrupter and, especially, on interior surfaces of the insulating end plates. Consequently, the dielectric strength of the vacuum interrupter will be improved.

Still another object of the present invention is to provide a vacuum interrupter, at least one insulating end plate of which is provided with a barrier preventing vaporized brazing material from dispersing into the vacuum chamber of the interrupter. In accordance with the vacuum interrupter, vacuum suface withstand voltage of the interior surfaces of the insulating end plates is improved up to about 80% over that of barrier-less insulating end plates previously developed by the present inventors and in addition the positioning of the other members of the interrupter to the present insulating end plate during temporary assembly of the vacuum is facilitated interrupter.

The other objects and advantages of the present invention will be apparent from the following description, claims and accompanied drawings.

BRIEF DESCRIPTION OF THE DRAWING

FIG. 1 is a longitudinal section of temporarily assembled vacuum interrupter in accordance with one embodiment of the present invention;

DESCRIPTION OF THE PREFERRED EMBODIMENT

Figure 2A:
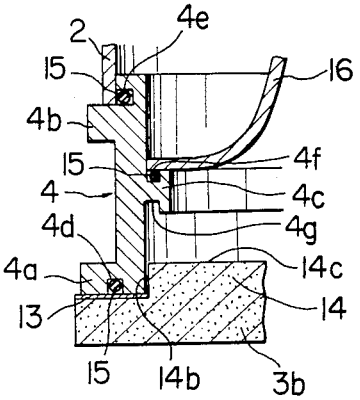
FIGS. 2A to 2F are enlarged views of circled parts A, B, C, D, E and F of FIG. 1, respectively.

As is apparent from FIG. 1 of the drawing, a vacuum chamber of a vacuum interrupter in accordance with the present invention is defined by the following members of the interrupter. That is, the members comprise a hollow metallic cylinder 2, two insulating end plates 3*a* and 3*b* provided at opposite ends of the metallic cylinder 2, first metallic, hollow-cylindrical, auxiliary sealing members 4 which are disposed between the metallic cylinder 2 and the insulating end plates 3*a* and 3*b* for the purpose of hermetically connecting the plates 3*a* and 3*b* to the metallic cylinder 2, a stationary electrical lead rod 5, a movable electrical lead rod 6 which moves into and out of contact with to the lead rod 5 along the coincident axes of the lead rods 5 and 6, a second metallic, hollow-cylindrical, auxiliary sealing member 7 for hermetically connecting the stationary lead rod 5 to the insulating end plate 3*a*, a bellows 8 surrounding the movable lead rod 6, a third metallic, ring-shaped, auxiliary sealing member 9 for hermetically connecting the outer end of the bellows 8 to the insulating end plate 3*b*, and a fourth metallic, ring-shaped, auxiliary sealing member 10 for hermetically connecting the movable lead rod 6 to the inner end of the bellows 8. Vacuum-tightness of the vacuum chamber of the vacuum interrupter 1 is achieved by vacuum brazing of contacting surfaces between the above members of the interrupter in a highly evacuated vacuum furnace.

The above-mentioned members of the interrupter will be described in detail.

The metallic cylinder 2 is made of austenitic stainless steel, which is non-magnetic and has a relatively large mechanical strength. However, in the case of vacuum interrupters with a relatively low current ratings, the metallic cylinder 2 may be made of thick walled copper or iron products or ferritic stainless steel products.

Figure 3:
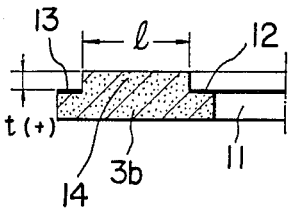
FIG. 3 is a cross-sectional view of a major portion of the insulating end plate in accordance with the embodiment of the present invention.

The disc-shaped insulating end plates 3*a* and 3*b* are made of ceramics, for example aluminum oxide ceramics $Al_2O_3$ or of crystallized glass. The outer diameter of the discs is substantially identical to that of the metallic cylinder 2. The insulating end plates 3*a* and 3*b* have central apertures 11 through which the stationary lead rod 5 and the movable lead rod 6 respectively extend into the metallic cylinder 2. The interior surfaces of the central and peripheral edges of the insulating end plates 3*a* and 3*b* are provided with annular central and peripheral shoulders 12 and 13, respectively. The annular central and peripheral shoulders 12 and 13 are preferably metallized to facilitate hermetically brazing. An annular barrier 14 which is formed between the annular central and peripheral shoulders 12 and 13 has a height t, as shown in FIG. 3, within the range of about 1 to 3 mm. Improvements in the vacuum surface withstand voltages of the insulating end plates 3*a* and 3*b* due to the annular barriers 14 will be detailed later. The annular barriers 14 shield the imaginary projections of the surfaces of the annular central and peripheral shoulders 12 and 13 from direct exposure to the vacuum chamber of the vacuum interrupter 1.

Figure 2B:
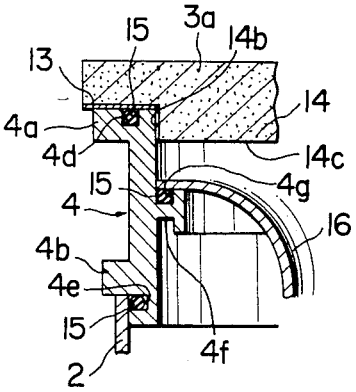
Figure 2C:
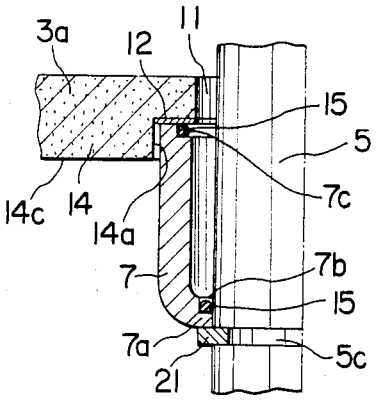

In other words, vaporized brazing material generated in the vicinity of the annular central and peripheral shoulders 12 and 13 is prevented from dispersing into the vacuum chamber of the vacuum interrupter 1, by the extremely narrow clearances (about 0.1 mm) between the central vertical faces 14*a* of the annular barriers 14 and outer peripheries of the second and third auxiliary sealing members 7 and 9 as shown in FIG. 2C and between the peripheral vertical faces 14*b* of the barriers 14, and the inner surfaces of the first auxiliary sealing members 4 as shown in FIGS. 2A and 2B.

In FIGS. 2A, 2B, 2C and 2E the clearances are exaggerated for easy understanding of the spatial relationships between the insulating end plates 3*a* and 3*b*, and the first, second and third auxiliary sealing members 4, 7 and 9.

The presence of the annular barriers 14 prevents vaporized brazing material generated at annular central and peripheral shoulders 12 and 13 respectively, from being deposited on surfaces 14*c* of the barriers 14.

The first auxiliary sealing member 4, the shape of which is shown in detail in FIGS. 2A and 2B is employed in order to improve reliability of hermetic seal between the metallic cylinder 2 and the insulating end plates 3*a* and 3*b* by eliminating thermal stresses due to the different coefficients of thermal expansion of the metallic cylinder 2 and the insulating end plates 3*a* and 3*b*.

In case the metallic cylinder 2 is made of austenitic stainless steel, and the insulating end plates 3*a* and 3*b* of aluminum oxide ceramics, the first auxiliary sealing members 4 may be made of Fe-Ni-Co alloy or of Fe-Ni alloy, the coefficient of thermal expansion of which approximates that of aluminum oxide ceramics. However, with regard to performance and cost, it is preferable to employ copper, the coefficient of thermal expansion of which is considerably larger than that of aluminum oxide ceramics, but which is intrinsically plastic and softens at a brazing temperature in the range of 900° C. to 1050° C. The first auxiliary sealing members 4 deform plastically and eliminate the thermal stresses generated between each sealing member 4 and the opposing insulating end plate 3*a* or 3*b* during the cooling process after the hermetic brazing. In the case of a vacuum interrupter for small currents, the first auxiliary sealing members 4 may be made of iron.

The shape of the first auxiliary sealing members 4 will be to described hereinafter in conjunction with FIGS. 2A and 2B. The end of the first hollow cylindrical auxiliary sealing member 4 in contact with the annular peripheral shoulder 13 of the insulating end plate 3*a* or 3*b* has a first outward flange 4*a*, and the other end has a second outward flange 4*b*. The first auxiliary sealing member 4 also has an inward flange 4*c* supporting an auxiliary shield 16, between the outward flanges 4*a* and 4*b*.

The flanges 4*a*, 4*b* and 4*c* of the auxiliary sealing member 4 facilitate positioning of the metallic cylinder 2, the insulating end plates 3*a* and 3*b* and the auxiliary shield 16. The auxiliary shield 16 is made of austenitic stainless steel or, in the case of vacuum interrupters for small currents may be made of iron.

The brazing surface of the first outward flange 4*a* has an annular brazing-material-accommodating groove 4*d*. Near the brazing surface of the second outward flange 4*b*, the first auxiliary sealing member 4 has another annular brazing-material-accommodating groove 4*e*.

The second outward flange 4*b* may alternatively include the annular brazing-material-accommodating groove in part of its surface on the atmospheric side of the vacuum interrupter 1 near the point of contact of the flange 4*b* to an annular end face of the metallic cylinder 2.

The opposite surface of the inward flange 4*c* of the first auxiliary sealing member 4 are suitable for brazing, and are provided with annular brazing-material-accommodating grooves 4*f* and 4*g* respectively. Since solid brazing material 15 in the annular brazing-material-accommodating grooves 4*d*, 4*e*, 4*f* and 4*g* does not project above the surfaces to be brazed, the accurate positioning of the members of the interrupter is not imparied.

Solid brazing material 15 in the brazing material-accommodating-grooves 4*d*, 4*e*, 4*f* and 4*g* is melted during vacuum brazing so that a suitable quantity will, penetrate between the annular peripheral shoulder 13 and the brazing surface of the first outward flange 4*a*, between the annular end face of the metallic cylinder 2 and the brazing surface of the second outward flange 4*b*, between the inner surface of one end of the metallic cylinder 2 and an outer periphery of the other end of the first auxiliary sealing member 4, and between the contacting surfaces of the auxiliary shield 16 and the inward flange 4*c*, due to the wetability between the molten brazing material and the surfaces of the elements of the interrupter.

Figure 2D:
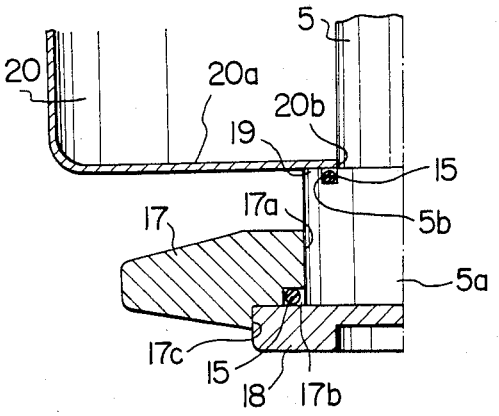

The stationary lead rod 5, a stepped shaft, is made of copper or copper alloy. As shown in FIG. 1, the stationary lead rod 5 comprises a relatively thick inner end portion 5*a* disposed within the vacuum chamber of the interrupter, and an outer end portion projecting outwards from the metallic cylinder 2 through the aperture 11 of the insulating end plate 3*a*. As shown in FIG. 2D, the inner end portion 5*a* of the stationary lead rod 5 is inserted into a central aperture 17*a* of a stationary disc-shaped electrode 17 near the periphery of the aperture 17*a* on the front face of the electrode 17, an annular brazing-material-accommodating groove 17*b* is provided. In addition, near the periphery of the annular groove 17*b* there is provided an annular contact accommodating groove 17*c* which is shallower than the annular brazing-material-accommodating groove 17*b*. The bottom of the contact accommodating groove 17*c* and the inner end of the stationary lead rod 5 lie flush so that the brazing-material-accommodating groove 17*b* is closed in part by the cylindrical surface of the inner end portion 5*a* of the stationary lead rod 5 and the bottom surface of a disc-shaped electrical contact 18 having a smaller diameter than that of the stationary electrode 17, by fitting the electrical contact 18 into the contact accommodating groove 17*c*.

The floor and the vertical side wall of the contact accommodating groove 17*c*, and the bottom and outer wall of the electric contact 18 form contact surfaces to be brazed. The composite surface to be brazed, extending from the brazing material accommodating groove 17*b* to the vacuum chamber of the interrupter 1, is right-angled, thereby entirely preventing vaporized brazing material from dispersing into the vacuum chamber of the interrupter.

As shown in FIGS. 1 and 2D, the outward-facing shoulder 19 of the inner end portion 5*a* of the stationary lead rod 5 is provided, with an annular brazing-material-accommodating groove 5*b*. The outer surface of the floor 20*a* of a cup-shaped arc shield 20 which surrounds the stationary lead rod 5 is to be brazed to the shoulder 19. In addition, the edge of a central aperture 20*b* in the floor 20*a* is to be brazed to the stationary lead rod 5. Thereby, the annular brazing-material-accommodating groove 5*b* is closed by the floor 20*a* of the arc shield 20. The shield 20 is made of the same material as that used in the auxiliary shield 16. An annular groove 5*c*, into which a snap ring 21 made of phosphor bronze, is to be fitted, is provided at a point between the annular shoulder 19 and the outer end portion of the stationary lead rod 5. The second auxiliary sealing member 7 is rigidly secured to the stationary lead rod 5 by means of the snap ring 21.

The second auxiliary sealing member 7, being a hollow copper cylinder, is employed in order to hermetically connect the stationary lead rod 5 with the insulating end plate 3*a* because although the stationary lead rod 5 is also made of copper or of copper alloy, its shape prevents it from plastically deforming during the cooling process after the hermetic brazing. The second auxiliary sealing member 7 works in the same way as the first auxiliary sealing member 4 during the cooling process. The second auxiliary sealing member 7 may be made of iron in the case00; of a small current vacuum interrupter.

The outer surface of an inward flange 7*a* which is formed at the inside end of the second auxiliary sealing member 7 contacts the upper surface of the snap ring 21. An annular brazing-material-accommodating groove 7*b* is provided near the edge of the inner surface of the inward flange 7*a*. The groove 7*b* is situated on the atmospheric side of the vacuum interrupter 1, so that vaporized brazing material will disperse only on the atmospheric side of the vacuum interrupter 1. Solid brazing material 15 in the annular brazing-material-accommodating groove 7*b* is melted during vacuum brazing so that a suitable quantity will penetrate between the contact surfaces of the stationary lead rod 5 and the edge of the inward flange 7*a* of the second auxiliary sealing member 7, and between the contact surfaces of the inward flange 7*a* and the snap ring 21, due to the wetability between the surfaces and the molten brazing material. The boundaries are perpendicular to each other.

An annular outer end surface of the second auxiliary sealing member 7 is to be brazed to the annular central shoulder 12 of the insulating end plate 3*a*. As shown in FIG. 2C, an annular brazing-material-accommodating groove 7*c* is provided along the inner edge of the outside end of the second auxiliary sealing member 7. The groove 7*c* is thus disposed on the atmospheric side of the vacuum interrupter 1 like the brazing-material-accommodating groove 7*b* in the inside end of the second auxiliary sealing member 7. Solid brazing material 15 in the brazing-material-accommodating groove 7*c* is melted during vacuum brazing so that a suitable quantity will penetrate between the outside end surface of the second auxiliary sealing member 7 and the annular central shoulder 12, due to the wetability between the ceramics and the molten brazing material.

The movable lead rod 6 is made of copper or copper alloy like the stationary lead rod 5, and has a substantially constant diameter. The inner end portion 6*a* of the movable lead rod 6 is in the vacuum chamber of the interrupter 1, while the outer end of the movable lead rod 6 projects outward from the metallic cylinder 2 through the aperture 11 of the insulating end plate 3*b*.

Figure 2E:
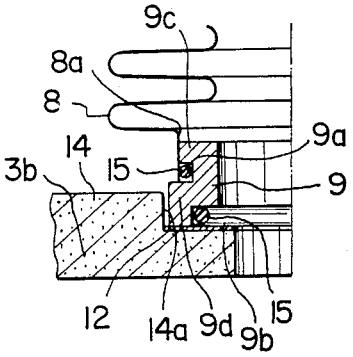
Figure 2F:
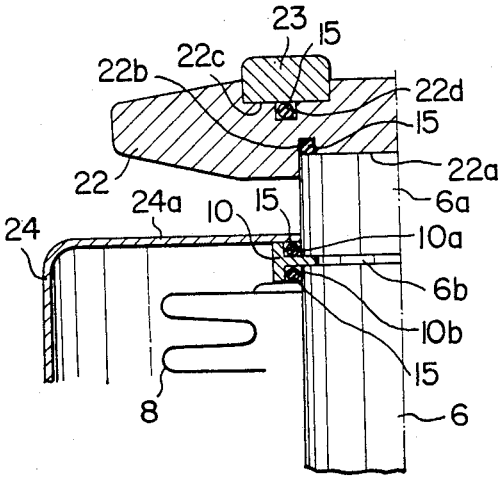

A movable disc-shaped electrode 22 which has substantially the same shape as the stationary electrode 17, as shown in FIG. 2F, is mounted on the inner end portion 6*a* of the movable lead rod 6 via a circular recess 22*a* provided at the center of the underside of the electrode 22. The circular recess 22*a* is provided, with an annular brazing-material-accommodating groove 22*b* about its periphery which is closed by the inner end surface of the movable lead rod 6. Solid brazing material 15 in the brazing-material-accommodating groove 22*b* is melted during vacuum brazing so that a suitable quantity will penetrate between the floor of the circular recess 22*a* and the inner end surface of the movable lead rod 6, and between the side wall of the circular recess 22*a*, and the cylindrical edge of the inner end portion 6*a* of the movable lead rod 6, due to the wetability between the surfaces and the molten brazing material.

As shown in FIG. 2F, the movable electrode 22 has an annular contact-fitting groove 22*c*. The floor of this groove 22*c* accommodates, an annular brazing-material-accommodating groove 22*d*. The groove 22*d* is closed by the underside of an annular electrical contact 23 which contacts the floor of the contact fitting groove 22*c*. Solid brazing material 15 in the brazing material accommodating groove 22*d* is melted during vacuum brazing so that a suitable quantity, will coat the right-angled boundary region bounded by the underside and adjoining side walls of the contact 23, and by the floor and adjoining side walls of the contact fitting groove 22*c*, due to the wetability between the surfaces and the molten brazing material.

The movable lead rod 6 is provided with an annular groove 6*b* which retains the fourth auxiliary sealing member 10. By means of the fourth auxiliary sealing member 10, a cup-shaped bellows shield 24 is to be brazed to the movable lead rod 6. The bellows shield 24 has the same shape as the arc shield 20 and is made of the same material.

The fourth auxiliary sealing member 10, which facilitates brazing of the bellows 8 and bellows shield 24 to the movable lead rod 6, may be made of either magnetic i.e. or non-magnetic material, but preferably of the latter. The fourth auxiliary sealing member 10 functions in the same way as the first auxiliary sealing member 4 during the cooling process after the hermetic brazing.

Both of the opposite surfaces of the fourth auxiliary sealing member 10 are provided with annular brazing-material-accommodating grooves 10*a* and 10*b*. Solid brazing material 15 is melted during brazing so that a suitable quantity will penetrate between the floor 24*a* of the arc shield 24 and the upper surface of the fourth auxiliary sealing member 10, between the movable lead rod 6 and the inner edge of the fourth auxiliary sealing member 10, and between the inner edge of the bellows 8 and the underside of the fourth auxiliary sealing member 10, due to the wetability between the surfaces and the molten brazing material.

FIG. 2E illustrates the connection between the bellows 8 and the insulating end plate 3*b* via the third auxiliary sealing member 9. The outer end of the bellows 8, which is made of austenitic stainless steel, forms a cylindrical brazing portion 8*a*. The third auxiliary sealing member 9 which comprises smaller and larger outer-diameter portions 9*c* and 9*d* is positioned between the cylindrical portion 8*a* of the bellows 8 and the annular central shoulder 12. Since the bellows 8 is about 0.1 mm thick, it is not important for the bellows 8 to have a coefficent of thermal expansion approximating that of the insulating end plate 3*b*, and the cylindrical portion 8*a* of the bellows 8 may be brazed directly onto the annular central shoulder 12. It is, however, preferable to employ the third auxiliary sealing member 9 which, during the cooling process after the hermetic brazing, functions in the same way as the first auxiliary sealing member 4, for the purpose of the hermetic brazing between the insulating end plate 3*b* and the bellows 8, because it ensures durable and reliable vacuum-tightness of the vacuum interrupter 1.

The smaller outer-diameter portion 9*c* of the third auxiliary sealing member 9 fits tightly within the cylindrical portion 8*a* of the bellows 8. An annular brazing-material-accommodating groove 9*a* is provided at the junction of the outer surfaces of the smaller outer-diameter portion 9*c* and the larger outer-diameter portion 9*d* of the third auxiliary sealing member 9. The end surface of the cylindrical portion 8*a* of the bellows 8 abuts the upper of the larger outer-diameter portion 9*d*.

The lower, inside edge of the larger outer-diameter portion 9*d* of the third auxiliary sealing member 9 is provided with an annular brazing-material-accommodating groove 9*b* situated in the atmospheric side of the vacuum interrupter 1. The end of the larger outer-diameter portion 9*d* of the third auxiliary sealing member 9 abuts the annular central shoulder 12 of the insulating end plate 3*b*. Solid brazing material 15 in the brazing material accommodating grooves 9*a* and 9*b* is melted during vacuum brazing so that a suitable quantity, will coat the outer surface of the smaller outer-diameter portion 9*c* and the internal surface of the cylindrical portion 8*a* of the bellows 8, the shoulder surface of the third auxiliary sealing member 9 and the end of the cylindrical portion 8*a* of the bellows 8, and the end of the larger outer-diameter portion 9*d* of the third auxiliary sealing member 9 and the surface of the annular central shoulder 12, due to the wetability between the surfaces and the molten brazing material.

Brazing material which may be used in conjunction with the present invention is a Cu-35%Mn-10%Ni alloy which has a 880° C. solid phase temperature and a 910° C. liquid phase temperature.

The vacuum interrupter 1, temporarily assembled as described above is manufactured in the following manner.

For temporary assembly of the vacuum interrupter 1, first, the insulating end plate 3*b* is horizontally supported by a suitable jig with the interior surface thereof upward. The insulating end plate 3*b* supports, the bellows 8, of which the cylindrical portion 8*a* is fitted over the third auxiliary sealing member 9. Also, the insulating end plate 3*b* supports and positions the first auxiliary sealing member 4 of which the first outward flange 4*a* supports and positions the metallic cylinder 2 and of which the inward flange 4*c* positions the auxiliary shield 16.

The auxiliary sealing members 4 and 9 are positioned on the insulating end plate 3*b* by obstructing the radial movement of the auxiliary sealing members 4 and 9 by means of the central side wall 14*a* and the peripheral side wall 14*b* of the barrier 14.

The bottom of the bellows shield 24 is mounted on the movable lead rod 6 in contact with the upper surface of the fourth auxiliary sealing member 10. In addition, the assembly of the movable electrode 22 and contact 23 is mounted on the inside end portion 6*a* of the movable lead rod 6. The movable lead rod 6 is inserted into the bellows 8 and, via the bellows 8, positioned on and supported by the insulating end plate 3*b*.

Next, solid brazing material 15 is inserted into each of the brazing material accommodating grooves.

The stationary electrode 17, the contact 18 and arc shield 20 are mounted on the inside end portion 5*a* of the lead rod 5. The snap ring 21 is mounted on an intermediate portion of the stationary lead rod 5, while the second auxiliary sealing member 7 is mounted in turn on the snap ring 21. The stationary lead rod 5 is inserted into the metallic cylinder 2 with the contact 18 resting on the contact 23 so as to be supported by the movable lead rod 6. The positioning of the stationary lead rod 5 with respect to the movable lead rod 6 is performed with a suitable jig.

The first upper auxiliary sealing member 4, via its second outward flange 4*b*, is positioned on the metallic cylinder 2 and in turn positions the auxiliary shield 16 via its inward flange 4*c*. The insulating end plate 3*a* is mounted on the first and second auxiliary sealing members 4 and 7, and is positioned coaxially over the stationary lead rod 5 by means of the central side wall 14*a* and the peripheral side wall 14*b* of the annular barrier 14.

Next, solid brazing material 15 is inserted into each of the brazing material accommodating grooves of the members.

Temporary assembly of the vacuum interrupter 1 is achieved by means of the above-described steps.

In vacuum brazing of the vacuum interrupter 1, the temporarily assembled vacuum interrupter is placed in the condition shown in FIG. 1 in a vacuum furnace which is evacuated to a pressure of $10^{-4}$ Torr or below and then heated to a temperature of 820° C. to 860° C. for the purpose of soaking for one to two hours. During the first heating step, the evacuation and outgassing of the vacuum chamber of the vacuum interrupter 1 via pores in the surfaces to be brazed; as well as the removal of oxide layers from metallic surfaces of the vacuum interrupter members, are completed before melting the solid brazing material 15. The heating temperature is preferably high but within the range in which the brazing material 15 remains solid. In addition, the pressure in the vacuum furnace is preferably as low as possible.

Next, during the second heating step, the vacuum furnace temperature is increased to 940° C. to 980° C., while the furnace is evacuated to a pressure under $10^{-5}$ Torr. The temperature rise activates the surfaces of austenitic stainless steel products as well as melts the solid brazing material 15, a suitable quantity of which, then coats the surfaces to be brazed, due to the wetability betweeen the surfaces and molten brazing material. Molten brazing material will thoroughly coat all of the surfaces to be brazed despite gravity. Specifically, for example, the first and second auxiliary sealing members 4 and 7 can be thoroughly brazed to the annular peripheral and central shoulders 13 and 12 of the insulating end plate 3*a* situated near to the stationary lead rod 5, respectively.

A first and a second slow cooling steps follow the second heating step. In the course of the first slow cooling step, the furnace temperature is decreased from the heating temperature in a second heating step to the fixed temperature above a room temperature and then remains at the fixed temperature for the fixed time. In the course of the second slow cooling, the furnace temperature is decreased to room temperature.

After the furnace temperature is decreased to room temperature in the course of the second slow cooling step, the vacuum interrupter 1 which has been completely brazed to achieve vacuum-tightness can be removed from the vacuum furnace.

Figure 5:
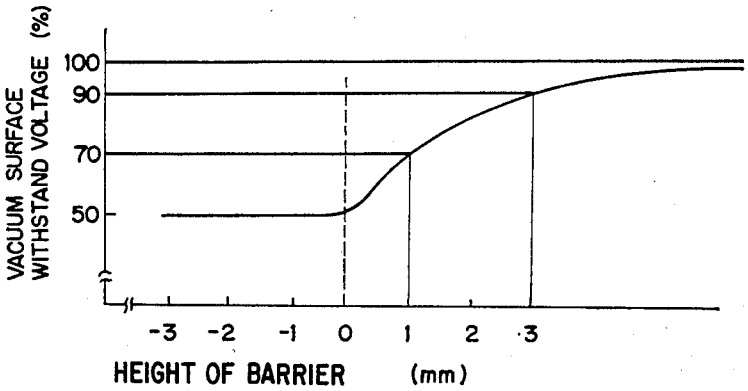
FIG. 5 is a graph of vacuum surface withstand voltage characteristics of insulating end plates in accordance with the present invention and the type which was developed previously by the inventors.

FIG. 5 is a graph of the vacuum surface withstand voltage of the insulating end plates 3*a* and 3*b* which is measured in the presence of the annular barrier 14 of the plates 3*a* and 3*b* by an impulse withstand voltage test method. For comparison, the tests were also carried out in cases where the height t of the barrier 14 was negative, i.e., both the central and peripheral shoulders 12 and 13 were higher than the part corresponding to the barrier 14, and where the height t of the annular barrier 14 was zero, i.e., both the central and peripheral shoulders 12 and 13 were as high as was the barrier 14. Impulse voltage was applied to a pair of two lead rods with spherical ends which were in contact with the central and peripheral edges of the inner surface of the barrier 14 separated by a distance l, (See FIG. 3).

The Y-axis of the graph of FIG. 5 indicates the ratio (%) of the measured vacuum surface withstand voltage of the insulating end plates 3*a* and 3*b* and the theoretical vacuum surface withstand voltage valve. The X-axis of the graph indicates the height t (mm) of the barrer 14.

As is apparent from FIG. 5, in the range of $t \leqq 0$, actual vacuum surface withstand voltage of the insulating end plates 3*a* and 3*b* amounts to about 50% of the theoretical value and in the range of $t > 0$, actual vacuum surface withstand voltage increases monotonically with t. For example, at $t = 1$ mm and at $t = 3$ mm, the actual vacuum surface withstand voltage of the insulating end plates 3*a* and 3*b* amounts to about 70% and about 90%, respectively of the theoretical value. However, since the characteristic curve of the actual vacuum surface withstand voltage of the insulating end plate 3*a* and 3*b* exhibits an increasing characteristic which increases asymptotically toward the theoretical value 100%, the actual vacuum surface withstand voltage of the insulating end plates 3*a* and 3*b* will be only slightly improved in the range of $t > 3$ mm even if the increase in t is relatively large.

Figure 4:
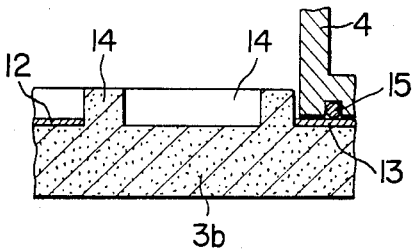
FIG. 4 is a cross-sectional view of a major portion of an insulating end plate in accordance with another embodiment of the present invention.

Since, as described above, the actual vacuum surface withstand voltage characteristics of the insulating end plates 3*a* and 3*b*, depends on the height t of the barrier 14, the advantage of two annular barriers 14, as shown in FIG. 4 is identical to that of the embodiment of FIG. 3.

The preceding description has been given in terms of an embodiment in which both ends of the metallic cylinder 2 are sealed by insulating end plates 3*a* and 3*b*, which is, however, only to facilitate understanding of the present invention.

The present invention, without deviation from the scope thereof, should be understood to be realizable in many modes not explicitly shown or described above.

What we claim is:

1. A vacuum interrupter which comprises:

(a) a hollow metallic cylinder;

(b) two insulating end plates which are made of inorganic insulating material attached to opposite ends of the metallic cylinder;

(c) a stationary lead rod and a movable lead rod which respectively extend into the metallic cylinder through the end plates and having inner ends which respectively support separable electrical contacts;

(d) a bellows between the movable lead rod and one of the end plates, one end of the bellows connecting to the movable lead rod and another end of the bellows connecting to the one end plate;

(e) at least a first auxiliary sealing member connected by means of brazing to an end of the metallic cylinder and to an end plate;

(f) grooves for accommodating solid brazing material, each of which is provided in at least one of a pair of opposing surfaces of members of the interrupter to be brazed and is closed from a vacuum chamber of the interrupter by the remaining members to be brazed opposing the groove; and wherein the vacuum chamber is defined by the metallic cylinder, the first auxiliary sealing member, the end plates, the stationary and movable lead rods and the bellows.

2. A vacuum interrupter as defined in claim 1, which further comprises:

second auxiliary sealing member by which the stationary lead rod is connected to the other end plate by means of brazing and which includes at least one groove which is adjacent to the other end plate and is open to the atmosphere.

3. A vacuum interrupter as defined in claim 1, wherein a depth of the groove is greater than a thickness of the solid brazing material.

4. A vacuum interrupter as defined in claim 2, wherein a depth of the groove in the second auxiliary sealing member is greater than a thickness of the solid brazing material.

5. A vacuum interrupter as defined in claim 1, wherein a surface of the end plate exposed to the vacuum chamber is provided with a shoulder to which another member of the interrupter is brazed and wherein an insulating barrier projects into the vacuum chamber from a shoulder level.

6. A vacuum interrupter as defined in claim 1, wherein the contact surfaces of the members of the interrupter to be connected by means of brazing define an angled path leading from the groove to the vacuum chamber.

* * * * *